US008407900B2

(12) United States Patent
Johnson

(10) Patent No.: US 8,407,900 B2
(45) Date of Patent: Apr. 2, 2013

(54) SHAVING CARTRIDGE HAVING MOSTLY ELASTOMERIC WINGS

(75) Inventor: Robert Harold Johnson, Melrose, MA (US)

(73) Assignee: The Gillette Company, Boston, MA (US)

( * ) Notice: Subject to any disclaimer, the term of this patent is extended or adjusted under 35 U.S.C. 154(b) by 175 days.

(21) Appl. No.: 13/040,510

(22) Filed: Mar. 4, 2011

(65) Prior Publication Data

US 2011/0247216 A1 Oct. 13, 2011

Related U.S. Application Data

(60) Provisional application No. 61/323,074, filed on Apr. 12, 2010.

(51) Int. Cl.
*B26B 21/00* (2006.01)
*B26B 21/40* (2006.01)

(52) U.S. Cl. ..... 30/50; 30/84

(58) Field of Classification Search ..... 30/34.05, 30/34.1, 34.2, 41, 47–51, 59, 65, 70, 74.1, 30/77–84; D28/47
See application file for complete search history.

(56) References Cited

U.S. PATENT DOCUMENTS

| | | | | | |
|---|---|---|---|---|---|
| 1,633,139 | A | * | 6/1927 | Staats-Oels | 30/50 |
| 1,825,494 | A | * | 9/1931 | Warner | 30/34.05 |
| 1,935,452 | A | * | 11/1933 | Kondolf | 30/77 |
| 2,275,810 | A | * | 3/1942 | Weiland | 30/34.2 |
| 2,568,047 | A | * | 9/1951 | Anderson | 30/34.2 |
| 2,698,995 | A | * | 1/1955 | Anastasia | 30/83 |
| 2,766,521 | A | * | 10/1956 | Benvenuti | 30/34.2 |
| 3,138,865 | A | * | 6/1964 | Meyer | 30/34.2 |
| 3,768,161 | A | * | 10/1973 | Miller | 30/41 |
| 3,802,072 | A | * | 4/1974 | Wintercorn | 30/81 |
| 3,969,817 | A | * | 7/1976 | DiBuono | 30/41 |
| 4,189,832 | A | * | 2/1980 | Harper et al. | 30/34.2 |
| 5,933,960 | A | * | 8/1999 | Avidor | 30/34.2 |
| 6,349,471 | B1 | * | 2/2002 | Gruslin et al. | 30/50 |
| 6,584,690 | B2 | | 7/2003 | Orloff et al. | |
| 7,178,241 | B1 | * | 2/2007 | Cummings et al. | 30/41 |
| 7,197,825 | B2 | | 4/2007 | Walker et al. | |
| D547,494 | S | * | 7/2007 | Watson et al. | D28/47 |
| D556,378 | S | * | 11/2007 | Watson et al. | D28/47 |

(Continued)

FOREIGN PATENT DOCUMENTS

| | | | | |
|---|---|---|---|---|
| CN | 102858503 | A | * | 1/2013 |
| EP | 2 078 593 | A1 | | 7/2009 |
| WO | WO 2007/056509 | A1 | | 5/2007 |
| WO | WO2011130219 | A1 | * | 10/2011 |

OTHER PUBLICATIONS

PCT International Search Report with Written Opinion in corresponding Int'l appln. PCT/US2011/032046 dated Jul. 14, 2011.
Persona M5 Magnum razor, "M5 Magnum," http://www.m5magnum.com/ (accessed on May 25, 2011) (1 page).

*Primary Examiner* — Jason Daniel Prone
(74) *Attorney, Agent, or Firm* — Kevin C. Johnson; Steven W. Miller

(57) ABSTRACT

Shaving cartridges intended for mounting on razor handles such that a shaving razors are formed. These cartridges include a frame on which a wing is disposed wherein a majority of the wing comprises elastomeric material.

5 Claims, 7 Drawing Sheets

U.S. PATENT DOCUMENTS

| | | | | |
|---|---|---|---|---|
| 7,540,088 | B2 * | 6/2009 | Takeshita | 30/34.2 |
| 7,703,361 | B2 * | 4/2010 | Johnson et al. | 30/77 |
| 7,877,879 | B2 * | 2/2011 | Nakasuka | 30/41 |
| 8,037,609 | B2 * | 10/2011 | Nicoll | 30/59 |
| 8,166,658 | B2 * | 5/2012 | Nakasuka | 30/41 |
| 8,191,263 | B2 * | 6/2012 | Follo et al. | 30/41 |
| 2002/0000040 | A1 * | 1/2002 | Gilder | 30/50 |
| 2002/0189103 | A1 * | 12/2002 | Brown et al. | 30/50 |
| 2006/0080837 | A1 * | 4/2006 | Johnson et al. | 30/50 |
| 2006/0080838 | A1 * | 4/2006 | Johnson et al. | 30/50 |
| 2006/0143925 | A1 * | 7/2006 | Johnson et al. | 30/50 |
| 2007/0110703 | A1 * | 5/2007 | O'Grady et al. | 30/34.2 |
| 2008/0209734 | A1 | 9/2008 | Nicoll | |
| 2008/0256800 | A1 * | 10/2008 | Nicoll | 30/50 |
| 2011/0247217 | A1 * | 10/2011 | Johnson et al. | 30/50 |
| 2012/0084984 | A1 * | 4/2012 | Davis | 30/50 |
| 2012/0151772 | A1 * | 6/2012 | Moon et al. | 30/41 |
| 2012/0216408 | A1 * | 8/2012 | Cook et al. | 30/41 |

* cited by examiner

SHAVING CARTRIDGE HAVING MOSTLY ELASTOMERIC WINGS

CROSS REFERENCE TO RELATED APPLICATIONS

This application claims the benefit of U.S. Provisional Application No. 61/323,074 filed Apr. 12, 2010.

FIELD OF THE INVENTION

This invention relates to a shaving cartridge that includes a mounted solid shaving aid that is mounted on a wing that is mostly elastomeric in its composition.

BACKGROUND OF THE INVENTION

Razors for wet shaving typically include a cartridge carried by a handle, the cartridge includes an elongate blade with a rectilinear sharpened edge, or a plurality of such blades with parallel edges. The cartridge may be fixedly mounted on the handle with the intention that the entire razor be discarded when the blade edge or edges have become dulled. Alternatively, the cartridge can be detachably connected to the handle to enable replacement of a used blade unit with a fresh cartridge.

Some shaving consumers, particularly women, use this type of razor in the shower. For example, when shaving her legs a woman will often apply a film or lather of soap to a first area of skin to be shaved, shave that area, apply soap to a second area, and shave that area. This process is repeated until shaving is complete. Shaving in this manner may be difficult and frustrating, as it generally requires the shaving consumer to hold a wet bar of soap in one hand while wielding a razor in the other hand, often while standing in an awkward position on a slippery shower floor.

Attempts have been made to address this problem by providing soap mounted on a razor. For example, U.S. Pat. No. 6,584,690 describes a razor that carries a shaving preparation, e.g., in the form of a solid cake of soap that surrounds the cartridge.

There still remains a need, however, to satisfy the sophisticated shaving consumers who desire a razor product that not only applies a shaving aid to the skin during the shaving experience but also one that provides an improved conformation to the uneven surface of the skin to be shaved.

SUMMARY OF THE INVENTION

The present invention features a shaving cartridge suitable for delivering a shaving aid to a user's skin during shaving in a manner that facilitates conformation of the shaving aid to the skin. In one aspect, the invention features a shaving cartridge comprising:

a) a frame comprising
   1) a front edge portion;
   2) a rear edge portion;
   3) a wing disposed on at least one or more of said front and rear edge portions wherein a majority of the wing comprises elastomeric material; and
b) a shaving aid portion mounted on said wing of said frame; and
c) a blade unit comprising a plurality of blades disposed between said front and rear edge portions.

The details of one or more embodiments of the invention are set forth in the accompanying drawings and the description below. Other features and advantages of the invention will be apparent from the description and drawings, and from the claims.

DETAILED DESCRIPTION OF THE INVENTION

Figure 1:
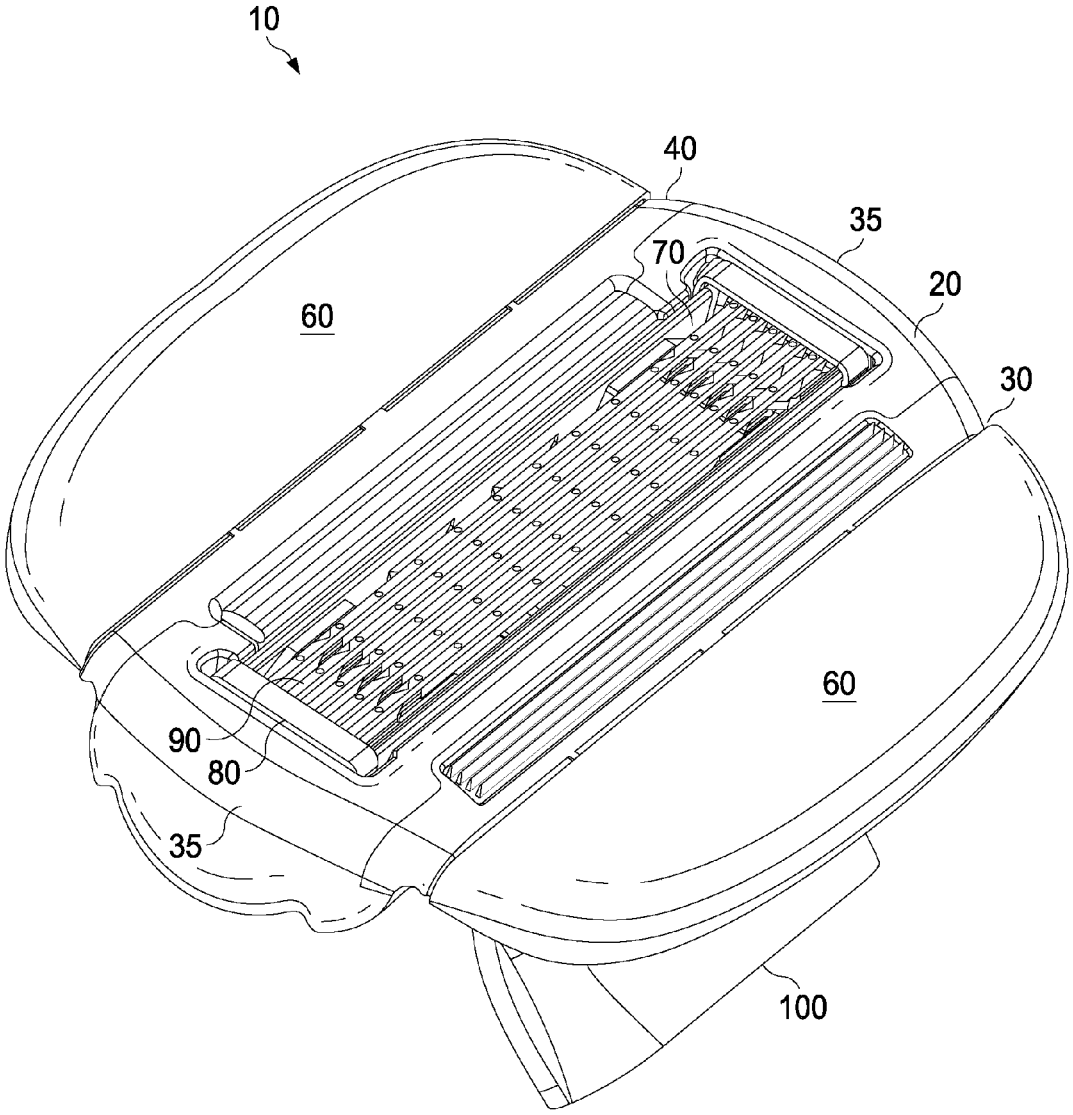
FIG. 1 is a front perspective view of the cartridge to one embodiment of the invention.
Figure 2:
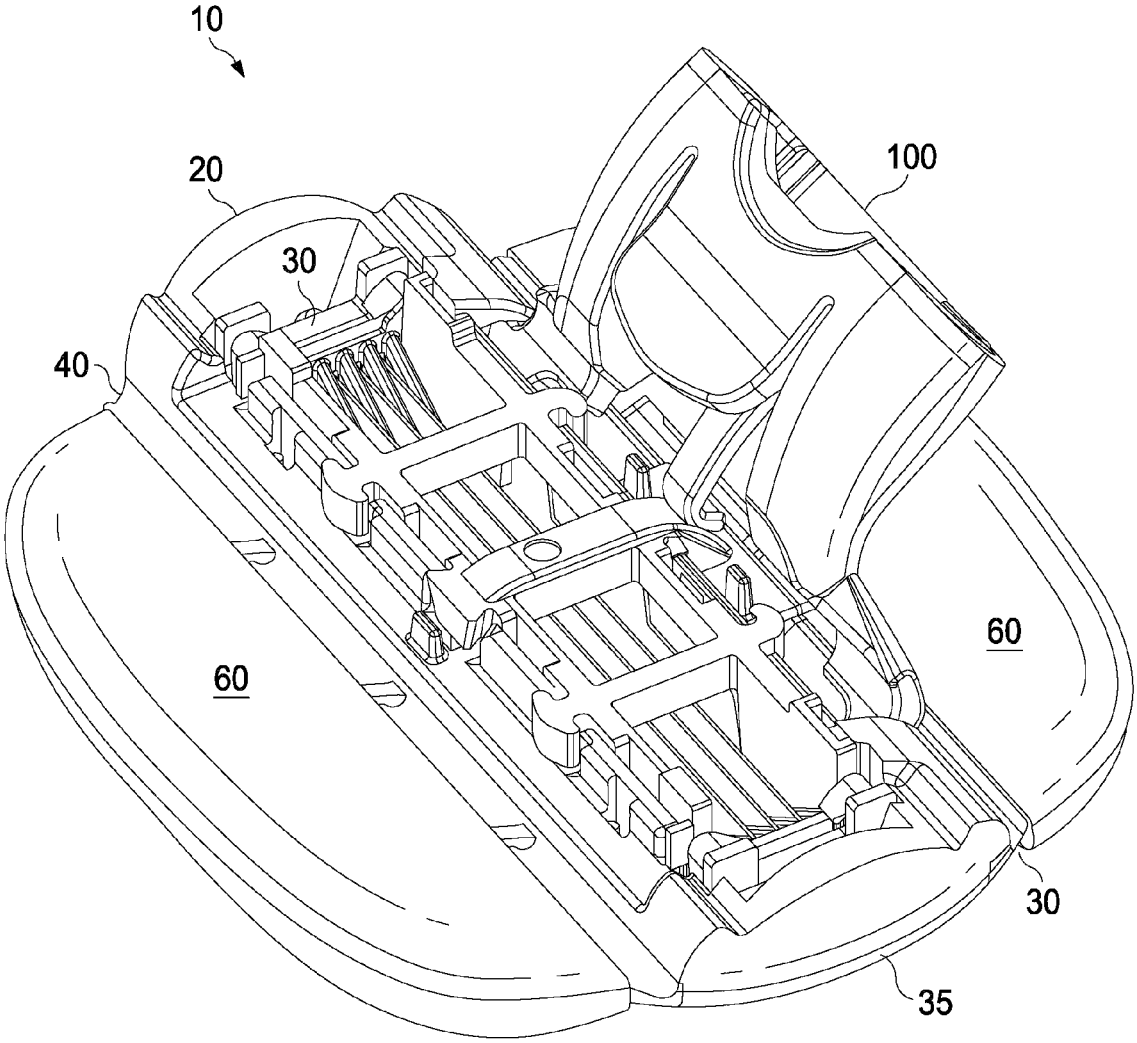
FIG. 2 is a rear perspective view of the cartridge of FIG. 1.
Figure 3:
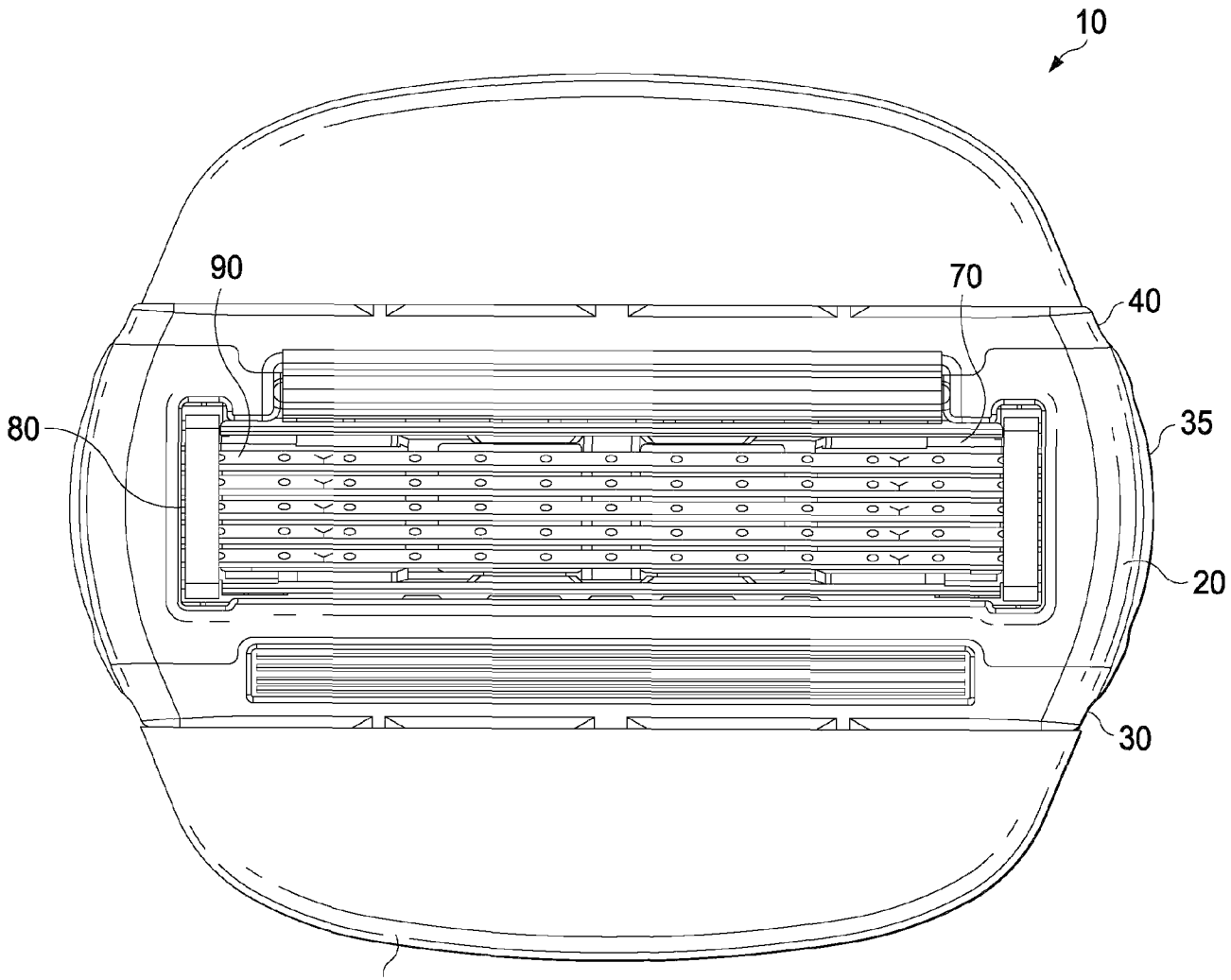
FIG. 3 is a top view of the cartridge of FIG. 1.

The present invention is directed to a shaving cartridge that exhibits improved conformation of a mounted shaving aid during use due to the present of one or more wings wherein a majority of such a wing comprises elastomeric material. As used herein, "majority" or "mostly" means greater than 50%, 60%, 70%, 80%, 90%, or even 100% is made of or includes an elastomeric material. Referring to FIGS. 1, 2, and 3, a shaving cartridge 10 of the present invention comprises a frame 20 which further includes a front edge portion 30 and a rear edge portion 40, which run parallel to one another. At one or more of the front and rear edge portions 30, 40 is shown disposition of a shaving aid portion 60. Disposed within an aperture 70 of the frame 20 is a blade unit 80 that comprises a plurality of blades 90. The frame 20 also has two opposing side edge portions 35 disposed perpendicularly to the front and rear edge portions 30, 40. The frame 20 of the cartridge is attached (either permanently or removably) to the blade unit 80. A hood 100 which pivots is shown. The hood serves as one part of an attachment mechanism between the cartridge 10 and a handle (not shown).

Figure 4:
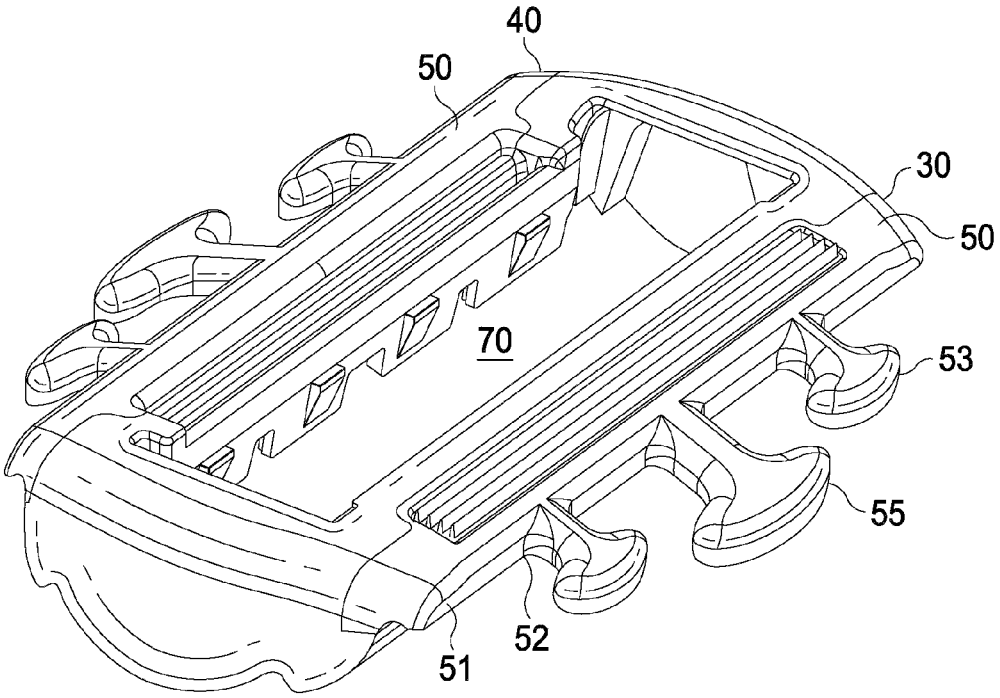
FIG. 4 is a front perspective view of one embodiment of a frame of a shaving cartridge of the present invention.
Figure 5:
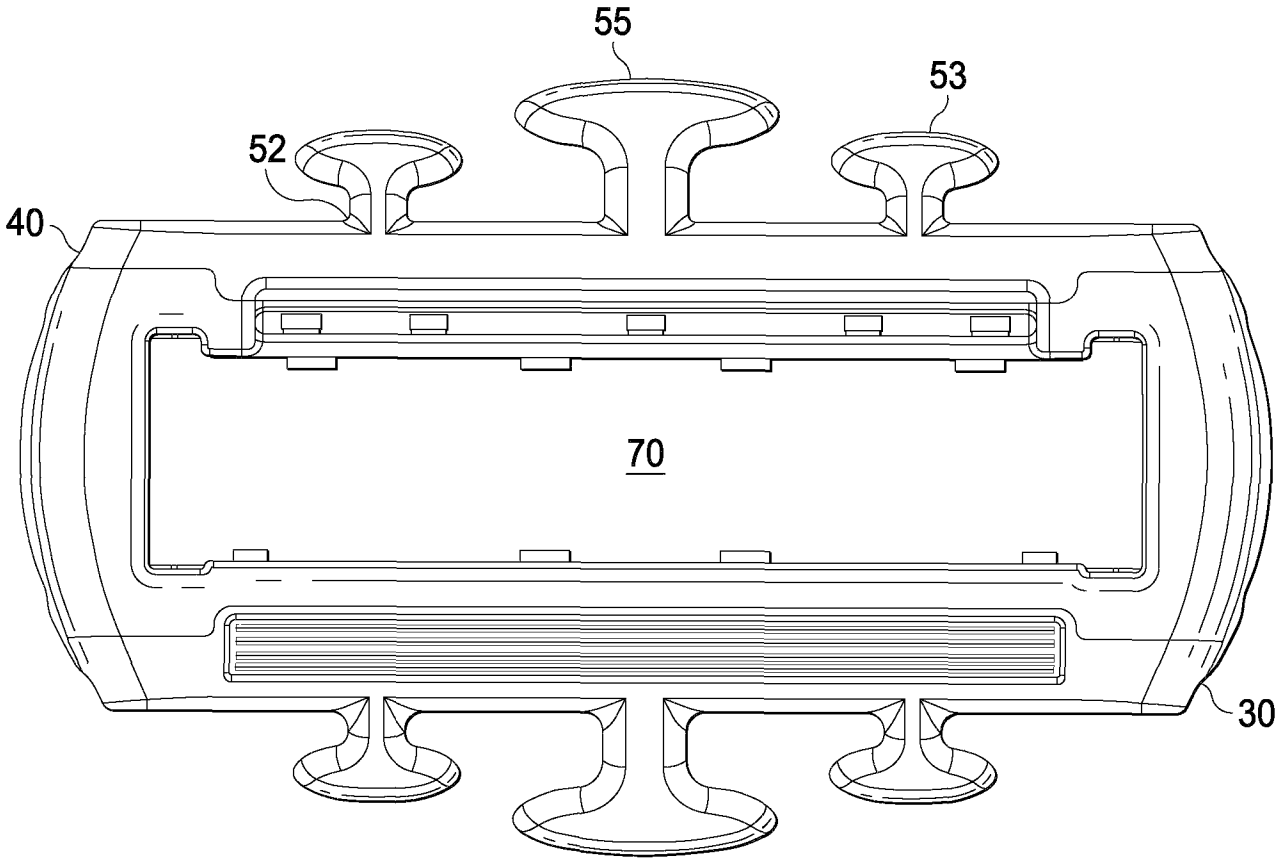
FIG. 5 is a top view of the frame of FIG. 4

FIGS. 4 and 5 each show the frame 20 with a wing 50 disposed at the front and rear edge portions 30, 40. The wing 50 comprises a plurality of wing tabs 55 that extend from a base 51 of the wing 50. The wing 50 may be joined to the frame via mechanical attachment, e.g., snapfitting an underside of the wing into recesses of the frame. Alternatively, the wing may be glued or bonded to the frame. In a particular embodiment, the wing which comprises a majority of elastomeric material may be joined via extruding the elastomeric material into a mold that contains a frame, which might be formed of rigid or semi-rigid plastic. Each wing tab 55 has a proximate end 52 and a distal end 53. In this embodiment, the wing tabs 55 are independently movable at their respective distal ends 53.

Figure 6:
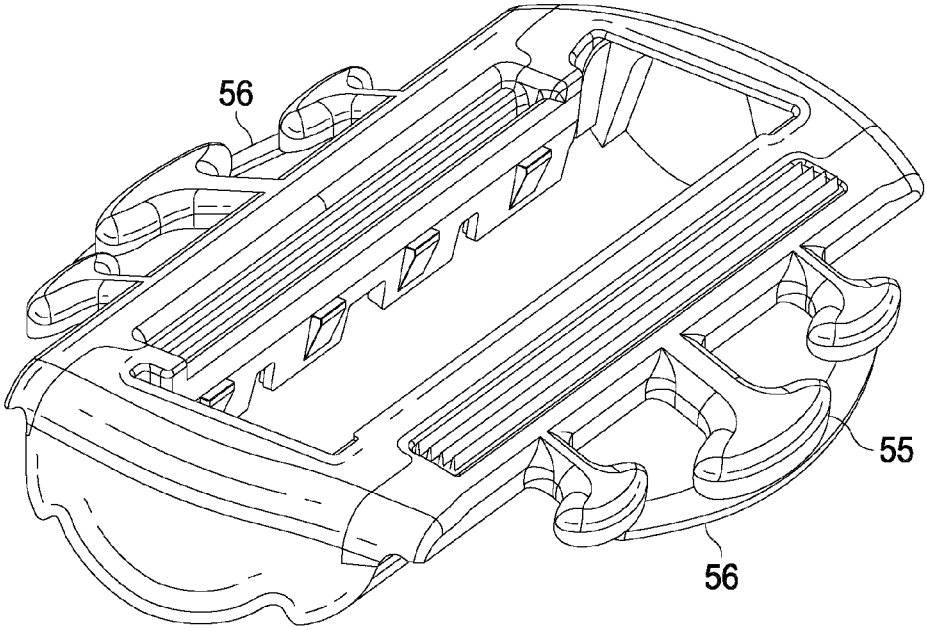
FIG. 6 is a front perspective view of a second embodiment of a frame of a shaving cartridge of the present invention.
Figure 7:
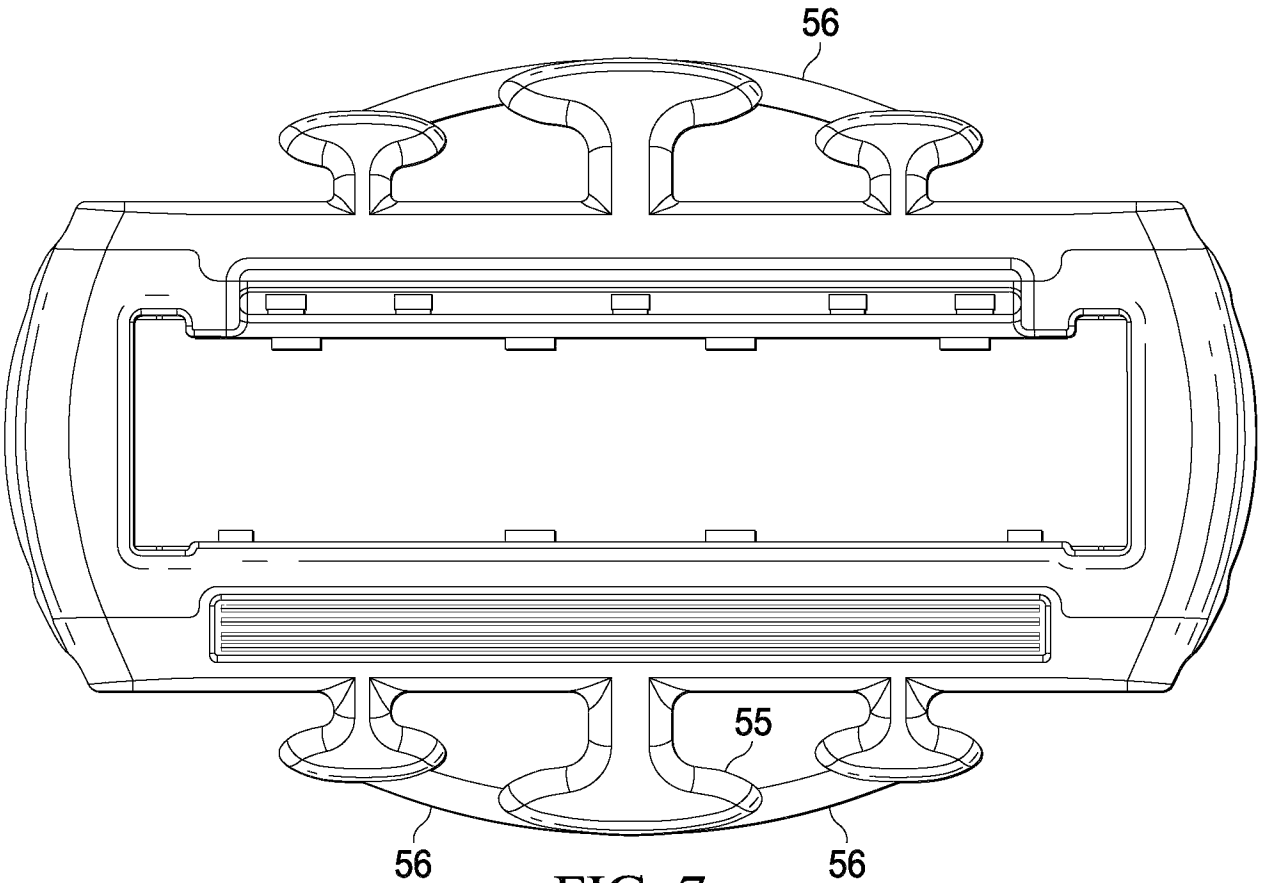
FIG. 7 is a top view of the frame of FIG. 6.

In FIGS. 6 and 7, an additional embodiment of the wing is shown. This embodiment includes a retention member 56 that joins one or more of the wing tabs 55 to one another to form a unitary wing. In this embodiment, the retention member 56 may span the distance between only two adjacent wing tabs or may span the distances between more than two wing tabs. Moreover, the retention member 56 may be present at the distal ends of the wing tabs or may be disposed between the distal and proximate ends of the respective wing tabs. The elastomeric material may have a hardness of less than about 50 Shore A, e.g., less than about 40 Shore A. The elastomeric material may be, for example, a block copolymer such as those available under the tradename KRATON®. In certain instances, the elastomeric material has sufficient chemical resistance so that it will not degrade during prolonged contact with the ingredients of the shaving aid portion.

The shaving aid 60 of FIGS. 1-3 is mounted on the wings via a method known to those skilled in the art, e.g., pour molding or extrusion molding. Without being limited by theory, Applicant believes that the elastomeric nature of the wing and the respective wing tabs facilitate the conformation of the various areas of the shaving aid (e.g., left side, right side, center portion) to shape to the skin of a shaving consumer independently as a function of the amount of shaving aid that is worn away during use. For instance, in the event the right side of the shaving aid is worn away more readily than the left side, the elastomeric wing tab(s) on a right side of the wing will be able to press toward the skin to deliver the remaining shaving aid on the right side as long as such shaving aid exists. Likewise, it is anticipated that the various areas of the shaving aid portion will be able to bias toward the skin independently as required by the shaving consumer's use to deliver shaving aid from the shaving aid portion.

Figure 8:
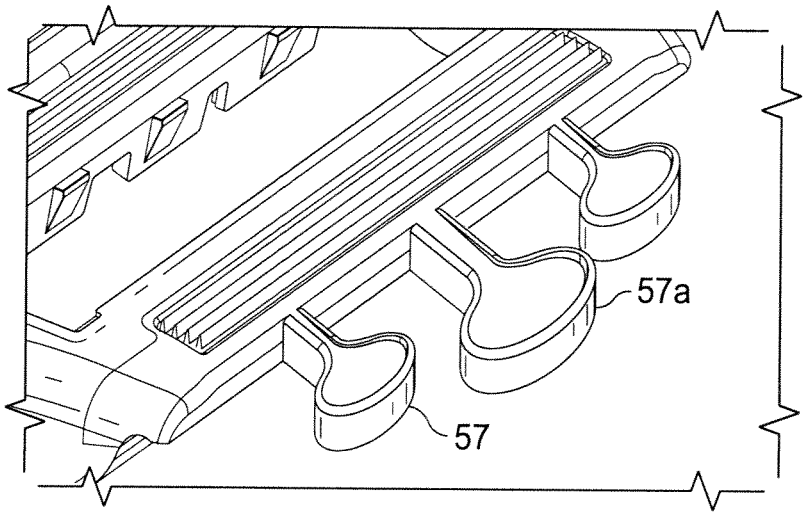
FIG. 8 shows a one embodiment of the plurality of wing tabs of the present invention.
Figure 9:
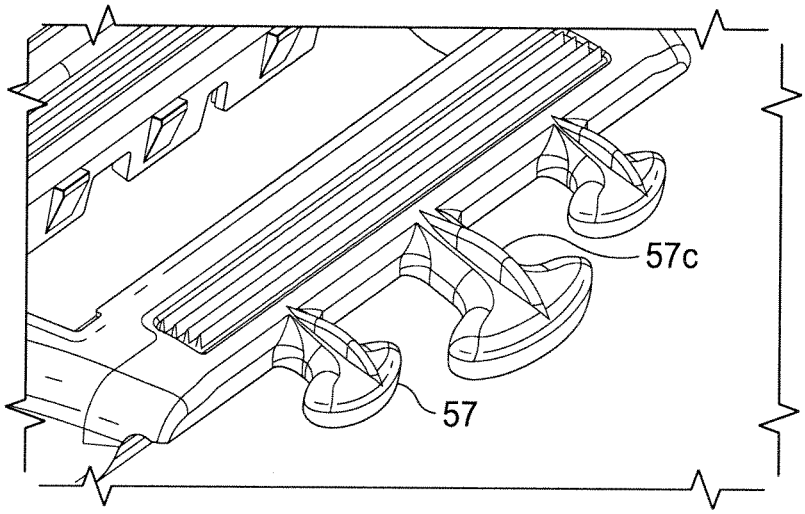
FIG. 9 shows a second embodiment of the plurality of wing tabs of the present invention.
Figure 10:
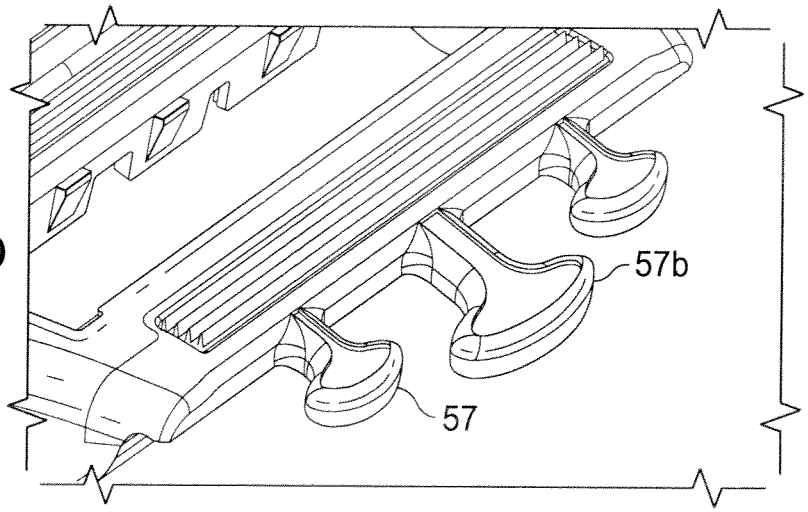
FIG. 10 shows a third embodiment of the plurality of wing tabs of the present invention.

FIGS. 8, 9, and 10 each depict an exploded detail view of varying embodiments of the wing tabs. These embodiments show a reinforcement member 57 in different forms. The wing may comprises a reinforcement member 57 selected from the group consisting of a peripheral rib 57*a*, 57*b*, a lateral rib (not shown), a longitudinal rib 57*c*, and combinations thereof. The peripheral rib 57*a*, 57*b* are disposed around an entirety of an edge portion of the wing tab. The longitudinal rib 57*c* is disposed along a longitude of a wing tab and likewise a lateral rib (not shown but envisioned) is disposed along a latitude of a wing tab. These reinforcement members 57 serve to add rigidity to the wing tabs in instances where more stiffness would be required to aid in the conformation of the shaving aid portion to the skin.

The shaving aid portion 60 of FIGS. 1-3 spans a width of the wing such that the wing tabs along a single wing are encompassed within a volume of the shaving aid portion. The shaving aid portion resiliently deflects upon contact with the skin, from a normal, undeflected (concave) position to various flexed positions. This deflection allows the razor to be easily used in hard to reach or confined areas, such as the armpit (axilla) or behind the knee. Deflection of the shaving aid portion also prevents premature wear of the shaving aid portion and discomfort to the user in cases where the user applies excessive pressure during shaving.

Any desired formulation may be used to form the shaving aid portions. In certain embodiments, the shaving aid portions have sufficient wear resistance so that the shaving aid portions last for the intended life of the cartridge. If desired, the frame may be removable and replaceable by the consumer, in which case the shaving aid portions may be exhausted before it is necessary to replace the cartridge.

In some instances, the shaving aid portions may include soap, e.g., poured or extruded soap. Such soap-based compositions may be modified to increase their hardness, wear resistance, lubricity and/or skin moisturizing and conditioning properties.

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A shaving cartridge comprising:

a) a frame comprising 1) a front edge 2) a rear edge 3) a wing disposed on at least one of said front and rear edges wherein a majority of at least one wing comprises elastomeric material, the at least one wing comprises a plurality of wing tabs each having proximate and distal ends; and b) a shaving aid portion mounted on said wing tabs; and c) a blade unit comprising a plurality of blades disposed between said front and rear edges portions.

2. The shaving cartridge of claim 1 wherein one or more of the wing tabs are independently movable at their respective distal ends.

3. The shaving cartridge of claim 1 wherein the distal ends of one or more of said wing tabs are joined to one another via a retention member.

4. The shaving cartridge of claim 1 wherein one or more of said wing tabs comprise a reinforcement member.

5. The shaving cartridge of claim 4 wherein said reinforcement member is disposed on a top surface of said one or more of said wing tabs.

* * * * *